US011363885B2

(12) United States Patent
Wu et al.

(10) Patent No.: US 11,363,885 B2
(45) Date of Patent: Jun. 21, 2022

(54) SLIDING RAIL POSITIONING DEVICE

(71) Applicant: Fulian Precision Electronics (Tianjin) Co., LTD., Tianjin (CN)

(72) Inventors: Chang-Ju Wu, New Taipei (TW); Chen-Sheng Tang, New Taipei (TW)

(73) Assignee: Fulian Precision Electronics (Tianjin) Co., LTD., Tianjin (CN)

( * ) Notice: Subject to any disclaimer, the term of this patent is extended or adjusted under 35 U.S.C. 154(b) by 0 days.

(21) Appl. No.: 17/021,233

(22) Filed: Sep. 15, 2020

(65) Prior Publication Data

US 2022/0047075 A1 Feb. 17, 2022

(30) Foreign Application Priority Data

Aug. 12, 2020 (CN) ..... 202010808789.9

(51) Int. Cl.
*A47B 88/423* (2017.01)
*A47B 88/45* (2017.01)
*A47B 88/57* (2017.01)

(52) U.S. Cl.
CPC ..... *A47B 88/423* (2017.01); *A47B 88/45* (2017.01); *A47B 88/57* (2017.01); *A47B 2088/4235* (2017.01)

(58) Field of Classification Search
CPC ..... A47B 88/45; A47B 88/423; A47B 88/57
USPC ..... 312/334.8, 334.44, 334.46
See application file for complete search history.

(56) References Cited

U.S. PATENT DOCUMENTS 7,520,577 B2 * 4/2009 Chen ..... A47B 88/493 312/333
8,585,166 B2 * 11/2013 Chen ..... A47B 88/493 312/334.46
8,950,834 B2 * 2/2015 Fan ..... H05K 7/1489 312/333
2004/0239221 A1 * 12/2004 Yang ..... A47B 88/57 312/334.46
2007/0164644 A1 * 7/2007 Hwang ..... A47B 88/49 312/333
2014/0339973 A1 * 11/2014 Fan ..... A47B 88/493 312/333

FOREIGN PATENT DOCUMENTS

TW 201242498 A1 10/2012
TW 201707614 A 3/2017

* cited by examiner

*Primary Examiner* — James O Hansen
(74) *Attorney, Agent, or Firm* — ScienBiziP, P.C.

(57) ABSTRACT

A sliding rail positioning device includes a first rail, a second rail, and a third rail. The second rail includes a second body and a second holding member. The second body defines a first receiving hole. The third rail includes a third body and a third holding member. When the second body is driven by the first rail to slide out, the third holding member is biased toward the second body to be received in the first receiving hole, so that the second body cannot be retracted back. When the first rail is retracted, the first rail presses the second holding member to press the third holding member out of the first receiving hole so that the second body can be retracted.

10 Claims, 11 Drawing Sheets

SLIDING RAIL POSITIONING DEVICE

FIELD

The subject matter herein generally relates to sliding rail assemblies, and more particularly to a sliding rail positioning device.

BACKGROUND

The existing ball-bearing sliding rail structure sandwiches a plurality of ball-bearing between inner and outer rails so as to achieve a telescopic effect of extending and retracting the inner and outer rails. However, the design of the ball-bearing sliding rail structure increases a thickness of the sliding rail structure.

BRIEF DESCRIPTION OF THE DRAWINGS

Implementations of the present disclosure will now be described, by way of embodiments, with reference to the attached FIGS.

DETAILED DESCRIPTION

Figure 1:
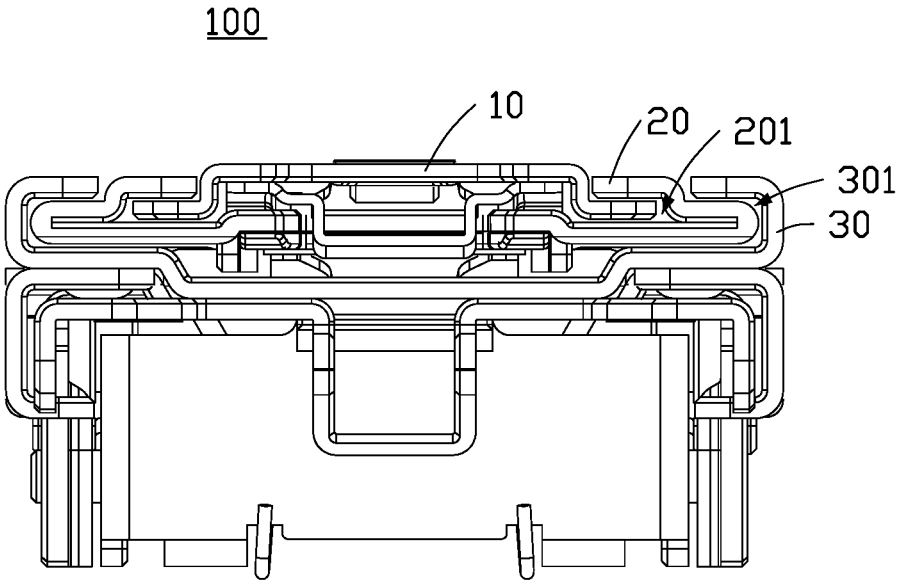
FIG. 1 is a cross-sectional diagram of a sliding rail positioning device according to an embodiment.

It will be appreciated that for simplicity and clarity of illustration, where appropriate, reference numerals have been repeated among the different FIGS. to indicate corresponding or analogous elements. Additionally, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or another word that "substantially" modifies, such that the component need not be exact. For example, "substantially cylindrical" means that the object resembles a cylinder, but can have one or more deviations from a true cylinder. The term "comprising" means "including, but not necessarily limited to"; it specifically indicates open-ended inclusion or membership in a so-described combination, group, series, and the like.

FIG. 1 shows a schematic diagram of an embodiment of a sliding rail positioning device 100. The sliding rail positioning device 100 can be applied to a supporting device such as a table, a cabinet, a server rack, or the like for sliding relative to the supporting device. The sliding rail positioning device 100 may carry a drawer, a server, or the like. The sliding rail positioning device 100 includes a first rail 10, a second rail 20, and a third rail 30. The second rail 20 defines a first sliding groove 201 along a sliding direction, and the third rail 30 defines a second sliding groove 301 along the sliding direction. The first rail 10 is slidably received in the first sliding groove 201 of the second rail 20, and the second rail 20 is slidably received in the second sliding groove 301 of the third rail 30.

Figure 2:
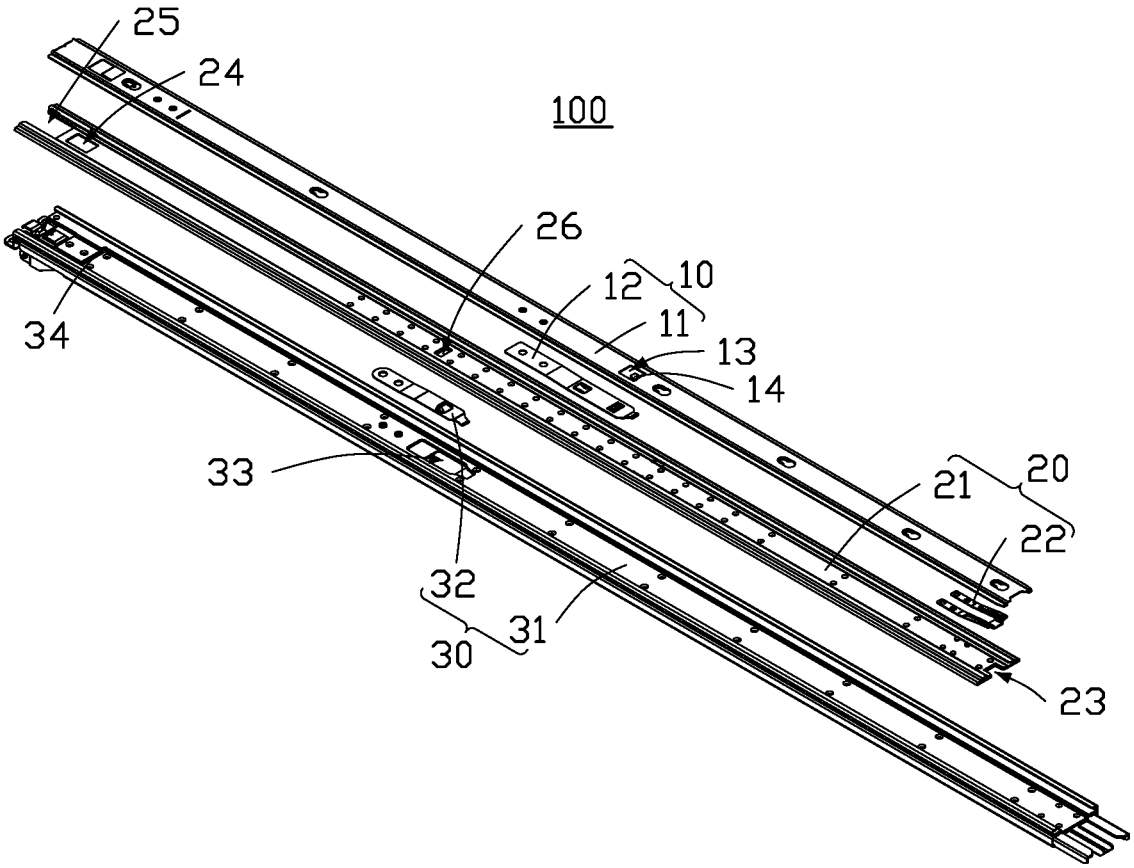
FIG. 2 is an exploded perspective diagram of the sliding rail positioning device shown in FIG. 1.
Figure 3:
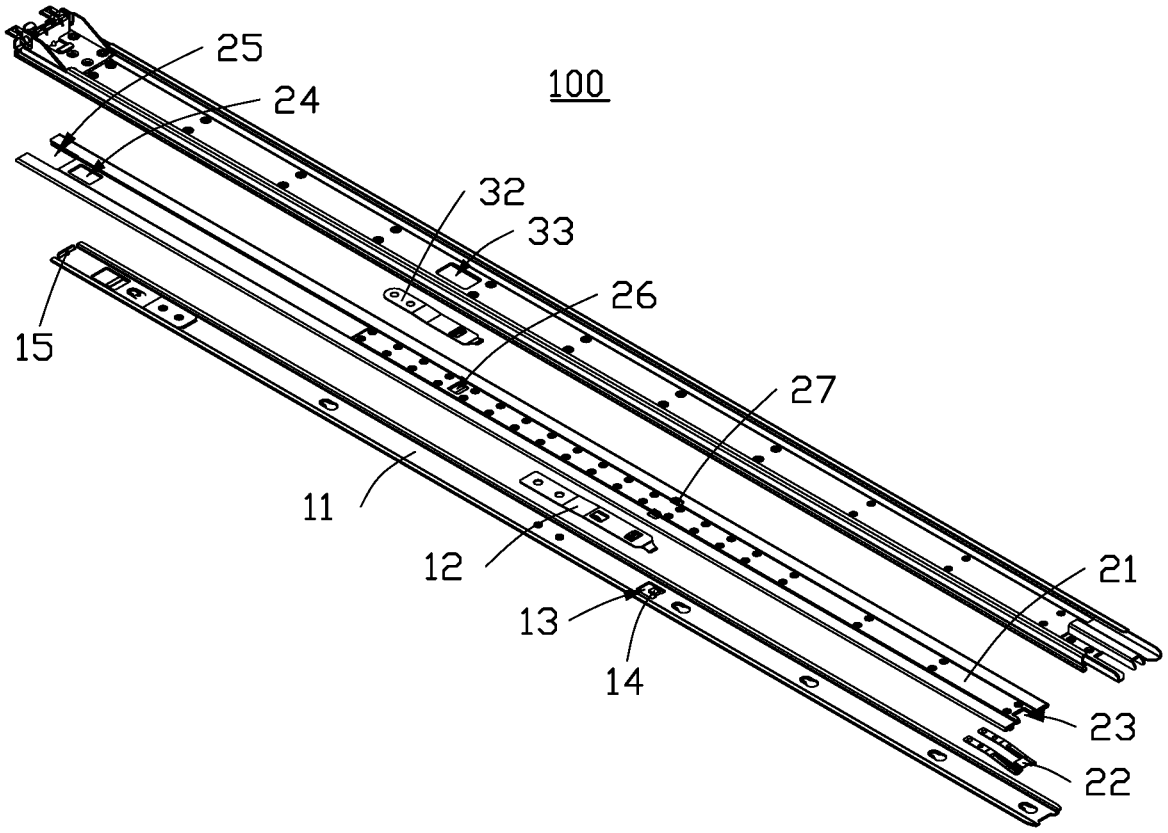
FIG. 3 is similar to FIG. 2, but shown from another angle.

Referring to FIGS. 2 and 3, the first rail 10 includes a first body 11 and a first holding member 12. The second rail 20 includes a second body 21 and a second holding member 22. The third rail 30 includes a third body 31 and a third holding member 32. The first body 11 is slidably coupled to the second body 21. The second body 21 is slidably coupled to the third body 31.

The first holding member 12 is arranged on the first body 11 and is biased toward the second body 21. The second holding member 22 is arranged on the second body 21 and is biased toward the first body 11. The third holding member 32 is arranged on the third body 31 and is biased toward the second body 21.

When the sliding rail positioning device 100 is in a retracted state, the first holding member 12 is held by the second body 21 and received between the first body 11 and the second body 21. The second body 21 defines a first receiving hole 23, and the second holding member 22 is held by the first body 11 and received in the first receiving hole 23. The third body 31 defines a second receiving hole 33, and the third holding member 32 is held by the second body 21 and received in the second receiving hole 33.

When the first body 11 slides out, the second holding member 22 is released and ejected from the first receiving hole 23. The second body 21 defines a latching hole 24. After the first body 11 slides out a certain distance, the first holding member 12 protrudes through the latching hole 24. The latching hole 24 clamps the first holding member 12 so that the first body 11 and the second body 21 are fixed together, so that the first body 11 and the second body 21 move together relative to the third rail 30. After the second body 21 slides out a certain distance, the third holding member 32 is released and ejected from the second receiving hole 33 to resist a wall of the first receiving hole 23, so that the second body 21 is prevented from being retracted back into the third body 31.

Figure 4:
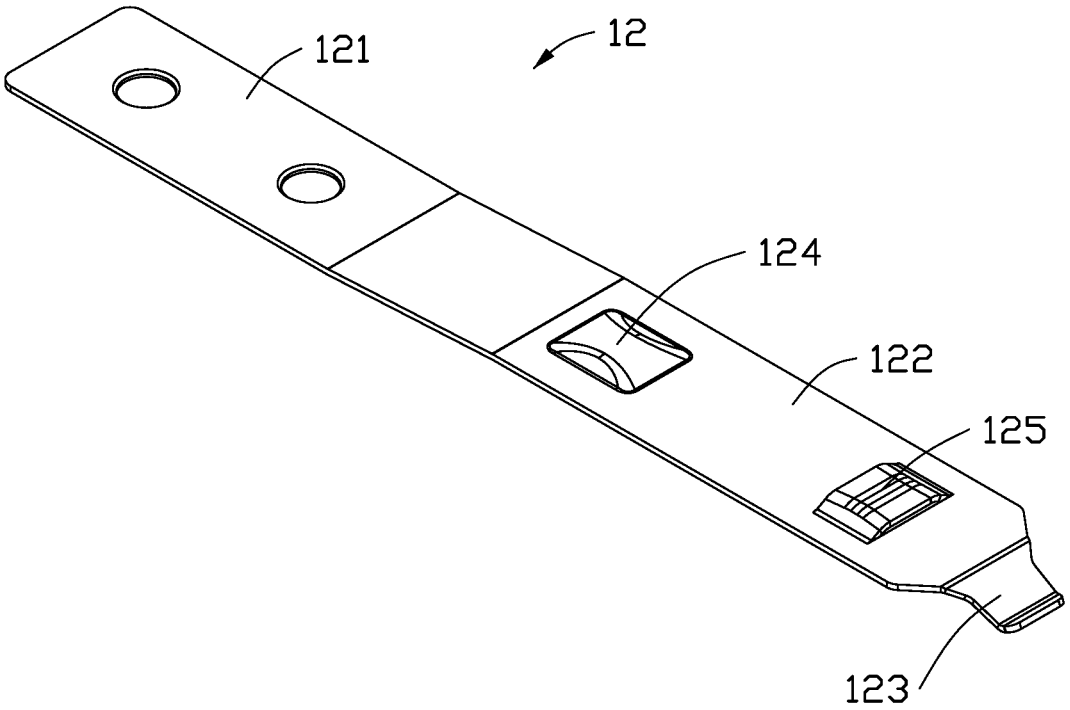
FIG. 4 is an enlarged schematic view of a first holding member of the sliding rail positioning device shown in FIG. 3.

The first body 11 defines a clearance hole 13 in substantially a middle portion of the first body 11. The first body 11 includes a hook 14 protruding into the clearance hole 13. Referring to FIG. 4, the first holding member 12 includes a first fixing portion 121, a first latching portion 122, and a first limiting portion 123. The first fixing portion 121 is fixedly coupled to the first body 11. The first latching portion 122 is biased toward the second body 21, and a surface of the first latching portion 122 facing the second body 21 is provided with a pressing protrusion 124 and a latching protrusion 125. The pressing protrusion 124 is located on a side of the latching protrusion 125 adjacent to the first fixing portion 121. The first limiting portion 123 extends into the clearance hole 13, and an end of the first limiting portion 123 away from the first fixing portion 121 abuts on the hook 14 to limit a height of the first holding member 12 popping out.

When the second body 21 is extended, the latching hole 24 is on a side of the second body 21 facing away from the third body 31. The second body 21 further defines a pressing hole 25 at a position adjacent to the latching hole 24. When the first body 11 slides out a certain distance, the first latching portion 122 of the first holding member 12 pops out, and the latching protrusion 125 protrudes into the latching hole 24 to be latched in the latching hole 24, so that the first body 11 and the second body 21 are fixed together, and the pressing protrusion 124 will protrude into the pressing hole 25. When the sliding rail positioning device 100 is to be retracted, the pressing protrusion 124 is manually pressed through the pressing hole 25, thereby pressing back the first latching portion 122 to disengage the latching protrusion 125 from the latching hole 24, so that the first body 11 can move relative to the second body 21 for retracting.

The first body 11 is provided with a first baffle 15. The first baffle 15 extends toward the second body 21 and is located on a side of the first body 11 away from the third body 31 when the first body 11 is extended. The first baffle 15 limits a sliding distance of the first body 11 when the first body 11 is retracted back to the second body 21.

In one embodiment, when the first body 11 is retracted back to the second body 21, the first baffle 15 resists the wall of the pressing hole 25 to limit the sliding distance of the first body 11, but is not limited to this.

In one embodiment, a limiting hole 26 is defined in substantially a middle portion of the second body 21. When the second body 21 is slidably retracted back to the third body 31, the limiting hole 26 can accommodate the third holding member 32, hold the third holding member 32, and limit a sliding distance of the second body 21. In other words, when the sliding rail positioning device 100 is in an initial state, the third holding member 32 is received in the limiting hole 26.

Figure 5:
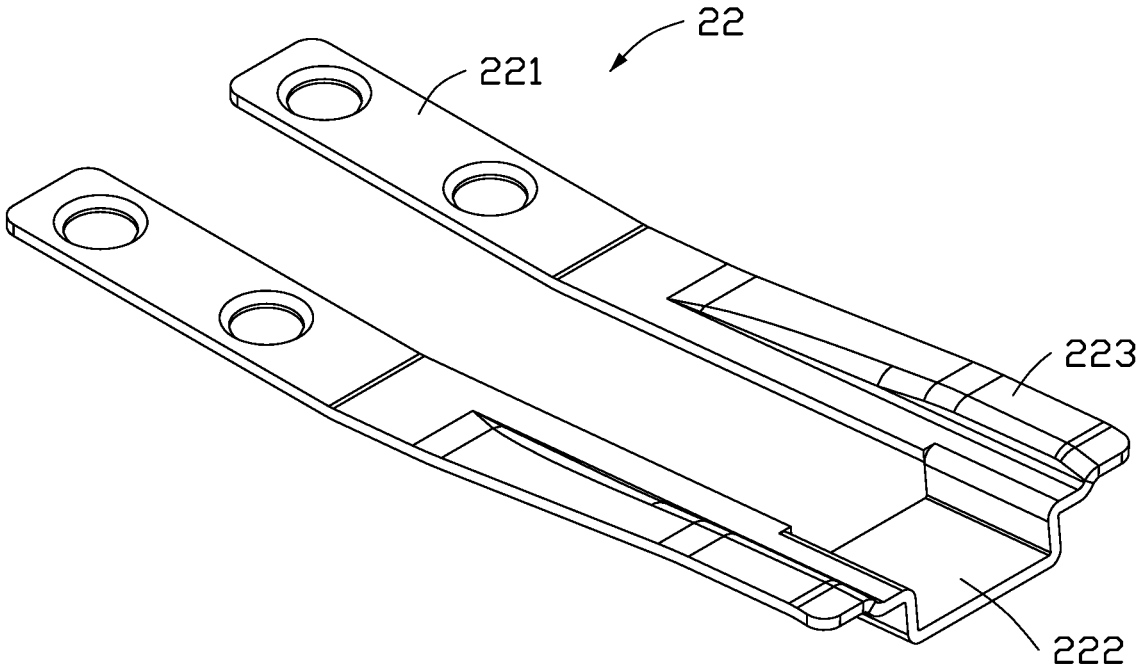
FIG. 5 is an enlarged schematic view of a second holding member of the sliding rail positioning device shown in FIG. 2.

The first receiving hole 23 is located on an end of the second body 21 away from the first baffle 15. Referring to FIG. 5, the second holding member 22 includes a second fixing portion 221, a second latching portion 222, and a pressing portion 223. The second fixing portion 221 is fixedly coupled to the second body 21. An end of the second holding member 22 away from the second fixing portion 221 is biased toward the first body 11. The second latching portion 222 is arranged toward the third body 31, and the pressing portion 223 is arranged toward the first body 11.

When the first body 11 is retracted back into the second body 21, the pressing portion 223 is pressed by the first body 11 so that the second latching portion 222 is received in the first receiving hole 23 to press the third holding member 32 held in the first receiving hole 23, so as to cause the third holding member 32 to be received in the second receiving hole 33.

In one embodiment, the second holding member 22 is substantially U-shaped, but is not limited to this. In other embodiments, the second holding member 22 may have other shapes.

Figure 6:
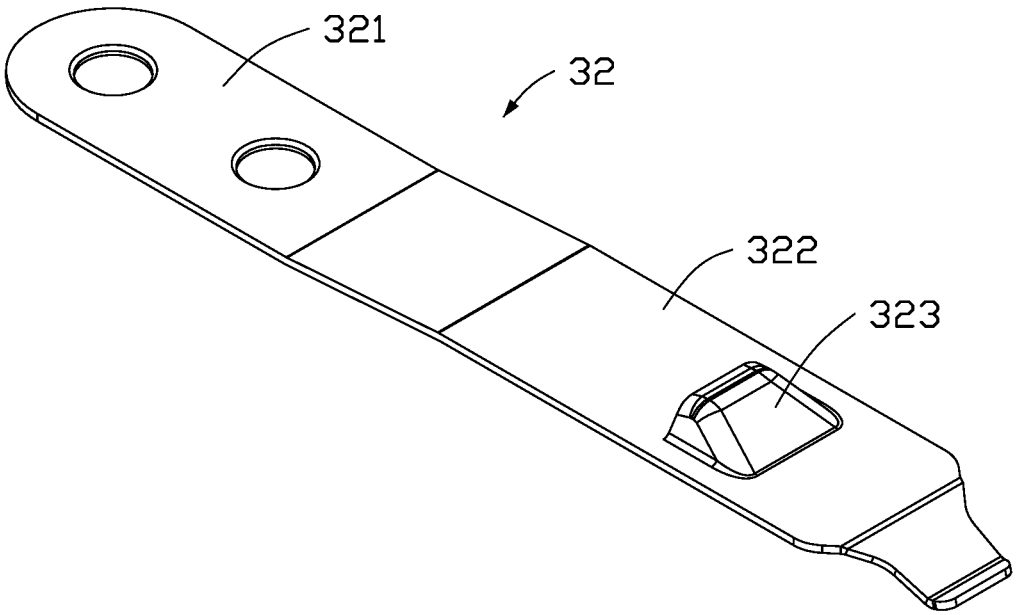
FIG. 6 is an enlarged schematic view of a third holding member of the sliding rail positioning device shown in FIG. 2.

The second receiving hole 33 is defined substantially in a middle portion of the third body 31. Referring to FIG. 6, the third holding member 32 includes a third fixing portion 321 and a third latching portion 322. The third fixing portion 321 is fixedly coupled to the third body 31. The third latching portion 322 is biased toward the second body 21, and a limiting protrusion 323 is provided on a side of the third latching portion 322 facing the second body 21. After the second body 21 slides a certain distance, the third latching portion 322 of the third holding member 32 pops out, and the limiting protrusion 323 is latched in the first receiving hole 23 so that the second body 21 cannot be retracted back into the third body 31.

A limiting member 34 is provided on a side of the third body 31 adjacent to the extended first body 11. A second baffle 27 is provided in substantially a middle portion of the second body 21. The second baffle 27 is located between the limiting hole 26 and the first receiving hole 23 and extends toward the third body 31. After the second body 21 slides a certain distance, the second baffle 27 resists the limiting member 34, thereby preventing the second body 21 from sliding out.

A working process of the sliding rail positioning device 1 will be described in detail below with reference to FIGS. 7-11.

Figure 7:
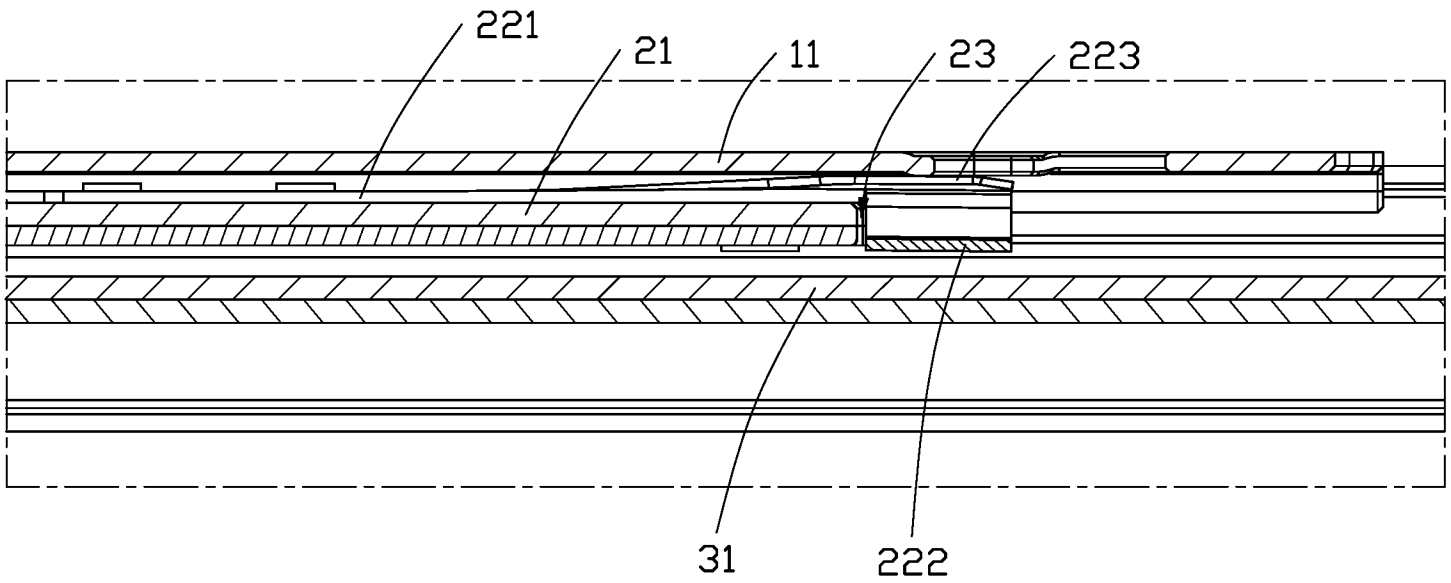
FIG. 7 is a cross-sectional view of the second holding member when the sliding rail positioning device shown in FIG. 1 is in an initial state.
Figure 8:
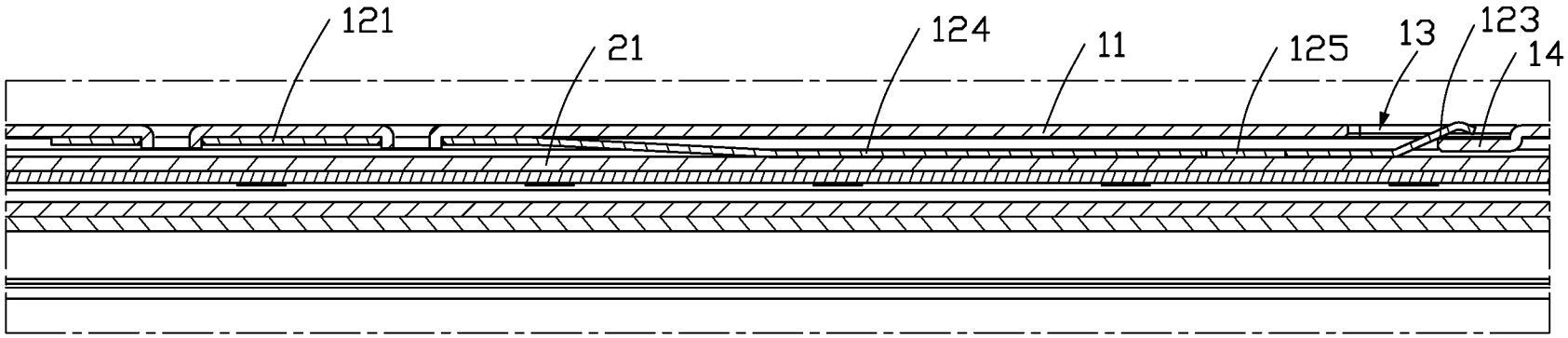
FIG. 8 is a cross-sectional view of the first holding member when the sliding rail positioning device shown in FIG. 1 is in the initial state.
Figure 9:
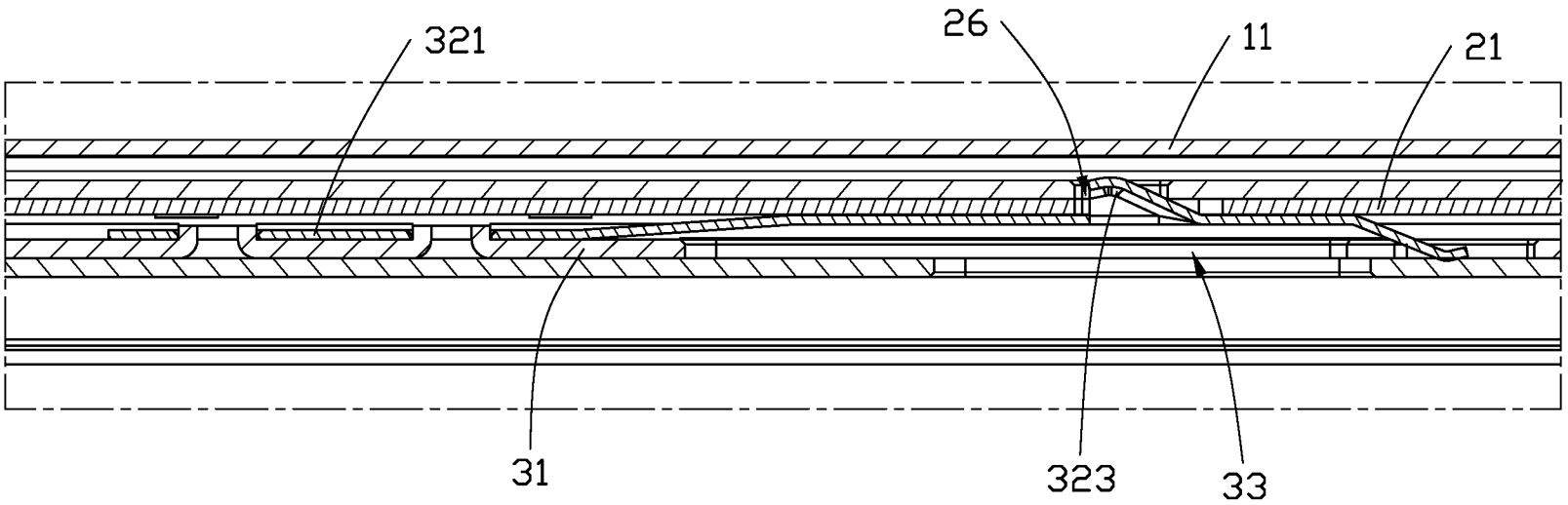
FIG. 9 is a cross-sectional view of the third holding member when the sliding rail positioning device shown in FIG. 1 is in the initial state.

Referring to FIG. 7, the sliding rail positioning device 100 is in the initial state. The pressing portion 223 of the second holding member 22 is pressed by the first body 11 so that the second latching portion 222 is received in the first receiving hole 23. The first latching portion 122 of the first holding member 12 is pressed by the second body 21 so that the pressing protrusion 124 and the latching protrusion 125 are received between the first body 11 and the second body 21 (as shown in FIG. 8). The limiting protrusion 323 of the third holding member 32 is received in the limiting hole 26 (as shown in FIG. 9).

Figure 10:
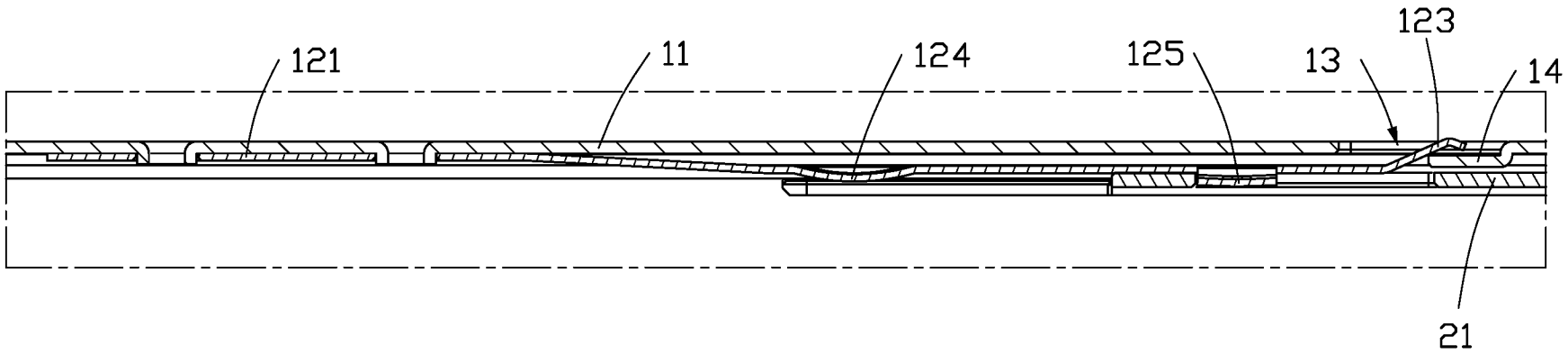
FIG. 10 is a cross-sectional view of the first holding member when the sliding rail positioning device shown in FIG. 1 is in an extended second state.
Figure 11:
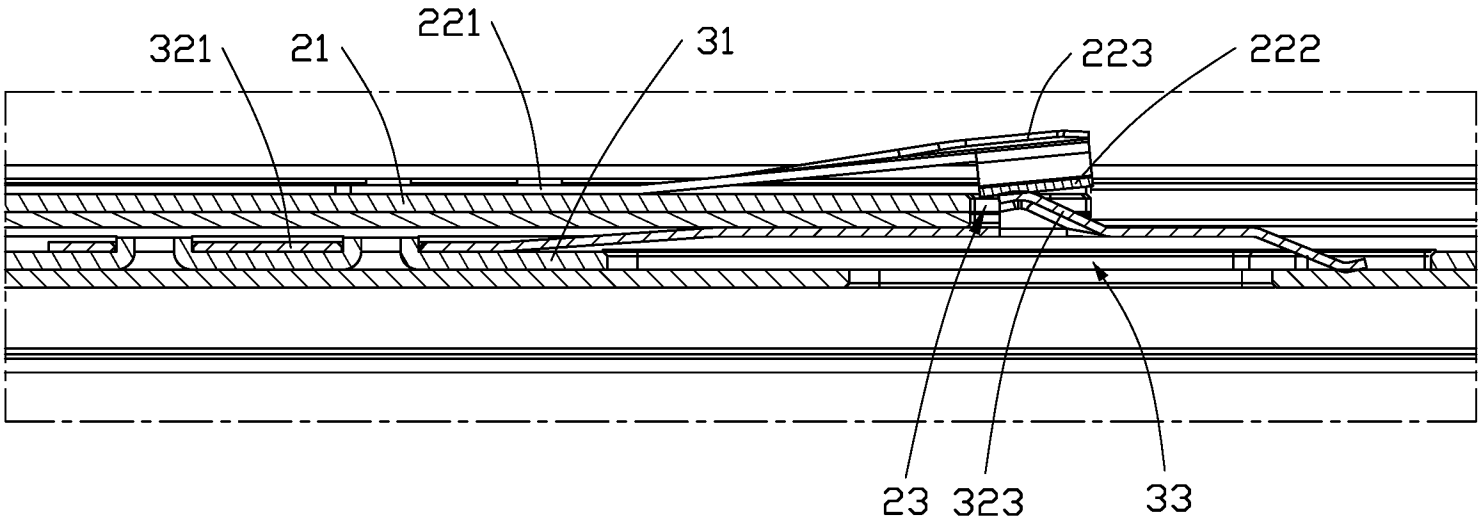
FIG. 11 is a cross-sectional view of the second holding member when the sliding rail positioning device shown in FIG. 1 is in the extended state.

When a force is applied to the first rail 10, the first body 11 slides outward, and the second holding member 22 will be released to cause the second latching portion 222 to move out from the first receiving hole 23 (as shown in FIG. 11). After the first body 11 extends a certain distance, the first latching portion 122 of the first holding member 12 pops out, and the latching protrusion 125 is received in the latching hole 24 and latched with the latching hole 24, so that the first body 11 is fixed to the second body 21, and the first body 11 drives the second body 21 to move relative to the third rail 30. At this time, the pressing protrusion 124 is received in the pressing hole 25 (as shown in FIG. 10). When the second body 21 slides out, the third latching portion 322 of the third holding member 32 slides out of the limiting hole 26 and is pressed by the second body 21 to be received in the second receiving hole 33 (not shown). When the second body 21 slides out a certain distance, the limiting protrusion 323 of the third holding member 32 is released from the second receiving hole 33 and abuts on the wall of the first receiving hole 23, thereby preventing the second body 21 from retracting back into the third body 31 (as shown in FIG. 11).

To retract the sliding rail positioning device 100, the pressing protrusion 124 is pressed through the pressing hole 25, and the first rail 10 is retracted, so that the first latching portion 122 is pressed back, thereby causing the latching protrusion 125 to disengage from the latching hole 24, so that the first body 11 can be retracted relative to the second body 21 (as shown in FIG. 10). When the first body 11 is retracted into the second body 21, the first body 11 presses the pressing portion 223 of the second holding member 22, so that the second latching portion 222 is pressed into the first receiving hole 23, and the second latching portion 222 resists the limiting protrusion 323 of the third holding member 32 to press the limiting protrusion 323 back into the second receiving hole 33, so that the second body 21 can be retracted relative to the third body 31, and then the second body 21 is retracted into the third body 31 (as shown in FIG. 11). After the second body 21 is retracted into the third body 31 a certain distance, the limiting protrusion 323 of the third holding member 32 is released into the limiting hole 26 to latch in the limiting hole 26, and the sliding rail positioning device 100 is in the initial state (as shown in FIG. 9).

In some embodiments, the second holding member 22 may also be provided on the first body 11, such as a protrusion provided on the end of the first body 11 facing the second body 21, so that when the first body 11 is retracted back into the second body 21, the protrusion can slightly press the third holding member 32 toward the second receiving hole 33, so that a surface of the third holding member 32 resisting a side wall of the first receiving hole 23 is slightly inclined, so that the second body 21 can continue to press down the side wall of the slightly inclined third holding member 32, so that the third holding member 32 is received in the second receiving hole 33.

The sliding rail positioning device 100 of the present application enables the first rail 10 to drive the second rail 20 to move relative to the third rail 30 through the cooperation of the first holding member 12 and the latching hole 24 to slide out to a designated position and length of the sliding rail positioning device 100. A compact structure and small thickness of the sliding rail positioning device 100 can be realized. Then, the second holding member 22 is pressed in the first receiving hole 23 by the first rail 10, so that the third holding member 32 received in the first receiving hole 23 is pressed and received in the second receiving hole 33, so that the second rail 20 moves relative to the third rail 30 and retracts.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. A sliding rail positioning device comprising:

a first rail;

a second rail, the first rail slidably coupled to the second rail; and a third rail, the second rail slidably coupled to the third rail, wherein:

the second rail comprises a second body and a second holding member, the second body defining a first receiving hole;

the third rail comprises a third body and a third holding member;

when the second body is driven by the first rail to slide out, the third holding member is biased toward the second body to be received in the first receiving hole, so that the second body cannot be retracted back; and when the first rail is retracted, the first rail presses the second holding member to press the third holding member out of the first receiving hole so that the second body can be retracted;

wherein the first rail comprises a first body and a first holding member, the second body defines a latching hole, the first holding member is biased toward the second body to be accommodated in the latching hole so that the first body drives the second body to slide out.

2. The sliding rail positioning device of claim 1, wherein:

the second holding member is biased toward the first body; and the second holding member can be pressed by the first body to be received in the first receiving hole.

3. The sliding rail positioning device of claim 1, wherein:

the first holding member comprises a first fixing portion and a first latching portion;

the first fixing portion is fixedly coupled to the first body;

the first latching portion is biased toward the second body, and a surface of the first latching portion facing the second body is provided with a latching protrusion; and the latching protrusion is configured to be accommodated in the latching hole.

4. The sliding rail positioning device of claim 3, wherein:

a side of the first latching portion facing the second body is provided with a pressing protrusion located on a side of the latching protrusion adjacent to the first fixing portion;

the second body further defines a pressing hole at a position adjacent to the latching hole; and the pressing protrusion is configured to be received in the pressing hole.

5. The sliding rail positioning device of claim 3, wherein:

the first body further defines a clearance hole;

the first body comprises a hook protruding into the clearance hole;

the first holding member further comprises a first limiting portion extending into the clearance hole; and an end of the first limiting portion away from the first fixing portion abuts on the hook.

6. The sliding rail positioning device of claim 1, wherein:

the second holding member comprises a second fixing portion, a second latching portion, and a pressing portion;

the second fixing portion is fixedly coupled to the second body;

an end of the second holding member away from the second fixing portion is biased toward the first rail;

the second latching portion is arranged toward the third body, and the pressing portion is arranged toward the first body; and the pressing portion is configured to be pressed by the first rail so that the second latching portion is received in the first receiving hole.

7. The sliding rail positioning device of claim 1, wherein:

the third holding member comprises a third fixing portion and a third latching portion;

the third fixing portion is fixedly coupled to the third body;

the third latching portion is biased toward the second body, and a side of the third latching portion facing the second body is provided with a limiting protrusion;

the limiting protrusion is configured to be accommodated in the first receiving hole and latched with the first receiving hole.

8. The sliding rail positioning device of claim 1, wherein:

the second body further defines a limiting hole; and when the second body is slidably retracted back to the third body, the limiting hole is configured to accommodate the third holding member and limit a sliding distance of the second body.

9. The sliding rail positioning device of claim 1, wherein:

the third body defines a second receiving hole; and the third holding member is configured to be held by the second body to be received in the second receiving hole.

10. A sliding rail positioning device comprising:

a first rail comprising a first body and a first holding member;

a second rail comprising a second body and slidably coupled to the first rail; and a third rail comprising a third body and slidably coupled to the second rail; wherein:

the second rail comprises second holding member, and the second body defines a first receiving hole and a latching hole, wherein the first holding member is biased toward the second body to be accommodated in the latching hole so that the first body drives the second body to slide out;

the third rail comprises a third holding member;

the first rail is configured to drive the second rail to move relative to the third rail through the cooperation of the first holding member and the latching hole to slide out to a designated position and length of the sliding rail positioning device;

when the second body is driven by the first rail to slide out, the third holding member is biased toward the second body to be received in the first receiving hole, so that the second body cannot be retracted back; and when the first rail is retracted, the first rail presses the second holding member to press the third holding member out of the first receiving hole so that the second body can be retracted.

* * * * *